United States Patent [19]

Steele

[11] Patent Number: 4,924,934

[45] Date of Patent: May 15, 1990

[54] ROTARY HEAT WHEEL CASSETTE ASSEMBLY

[75] Inventor: Donald F. Steele, Cohasset, Mass.

[73] Assignee: Airxchange, Inc., Rockland, Mass.

[21] Appl. No.: 167,334

[22] Filed: Mar. 14, 1988

[51] Int. Cl.[5] ..... F28D 19/04

[52] U.S. Cl. ..... 165/8; 165/10; 165/78; 165/54

[58] Field of Search ..... 165/8, 10

[56] References Cited

U.S. PATENT DOCUMENTS 3,789,916 2/1974 Lindahl ..... 165/10

4,473,108 9/1984 Jansson et al. ..... 165/10

*Primary Examiner*—Albert W. Davis, Jr.

*Attorney, Agent, or Firm*—Schiller, Pandiscio & Kusmer

[57] ABSTRACT

A rotary regenerative heat exchange assembly comprises (1) heat exchange wheel means including a heat exchange wheel having a rotation axis and rotably mounted for rotation about said axis and means for rotating said wheel about said axis; and (2) cabinet means comprising openings for securing said assembly to a source of relatively cool air and to a source of relatively warm air so that when said assembly is properly located in an operative position in said cabinet means a portion of said wheel intercepts the flow of said relatively cool air and another portion of said wheel intercepts the flow of said relatively warm air, said cabinet means including means for slidably supporting said heat exchange wheel means and an opening so that said heat exchange wheel means can be slid into said cabinet means to said operative position, and at least partially moved out of said cabinet means so that said wheel can be maintained and/or replaced.

5 Claims, 3 Drawing Sheets

ROTARY HEAT WHEEL CASSETTE ASSEMBLY

The present invention relates to an improved energy recovery system, and more particularly to an improved rotary regenerative heat exchange assembly particularly adapted for use in relatively large HVAC systems and constructed to be easily repaired and maintained.

In designing and installing relatively large capacity HVAC units it is the customary practice to size the cooling and heating equipment to handle both the building load and the ventilation load at the extremes of summer and winter design conditions. To assure comfort above and below these temperatures that only occur during approximately 2.5% of a total heating or cooling season, oversizing of equipment is standard practice, adding significant capital cost for heating and cooling capacity that is only utilized a small percentage of the year.

To solve the energy cost problems associated with these HVAC units, people have closed outside air dampers. This achieves a reduction in the energy consumption for heating and cooling a building, but creates poor ventilation.

It is generally known that rotary regenerative heat exchange assemblies can be used to capture heat and moisture from warm air and transfer the heat and moisture to cool air. Thus, when heating a building and cool dry air is drawn from the outside into the building and heated moist air is exhausted from the building, a rotary regenerative heat wheel assembly can be utilized to capture some of the heat and moisture from the exiting air, and transfer the heat and moisture to the incoming air. Conversely, when cooling a building, a rotary regenerative heat wheel assembly can be utilized to capture some of the heat and humidity from the incoming air and transfering the heat and humidity to the exiting air so that cooler, dryer air enters the building Incorporating a rotary regenerative heat exchange assembly in HVAC systems can create problems regarding maintenance and repair of the assembly.

Accordingly, it is a general object of the present invention to provide a rotary regenerative heat exchange assembly constructed to be used with relatively large capacity HVAC system so as to reduce the required equipment size, and therefore the overall cost of the system.

It is another object of the present invention to provide a rotary regenerative heat exchange assembly adapted to be used with a HVAC system, which can easily be connected in the duct work or the HVAC equipment of the system.

Another object of the present invention is to provide an improved rotary regenerative heat exchange assembly adapted to be used in a HVAC system and constructed so that the assembly can be easily maintained and repaired.

These and other objects of the present invention are achieved by a rotary regenerative heat exchange assembly comprising:

heat exchange wheel means including a heat exchange wheel having a rotation axis and rotably mounted for rotation about said axis and means for rotating said wheel about said axis; and cabinet means comprising openings for securing said assembly to a source of relatively cool air and to a source of relatively warm air so that when said assembly is properly located in an operative position in said cabinet means a portion of said wheel intercepts the flow of said relatively cool air and another portion of said wheel intercepts the flow of said relatively warm air, said cabinet means including means for slidably supporting said heat exchange wheel means and an opening so that said heat exchange wheel means can be slid into said cabinet means to said operative position, and at least partially moved out of said cabinet means so that said wheel can be maintained and/or replaced.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawings wherein.

The same numerals are used in the various figures of the drawings to designate the same or similar parts.

Figure 1:
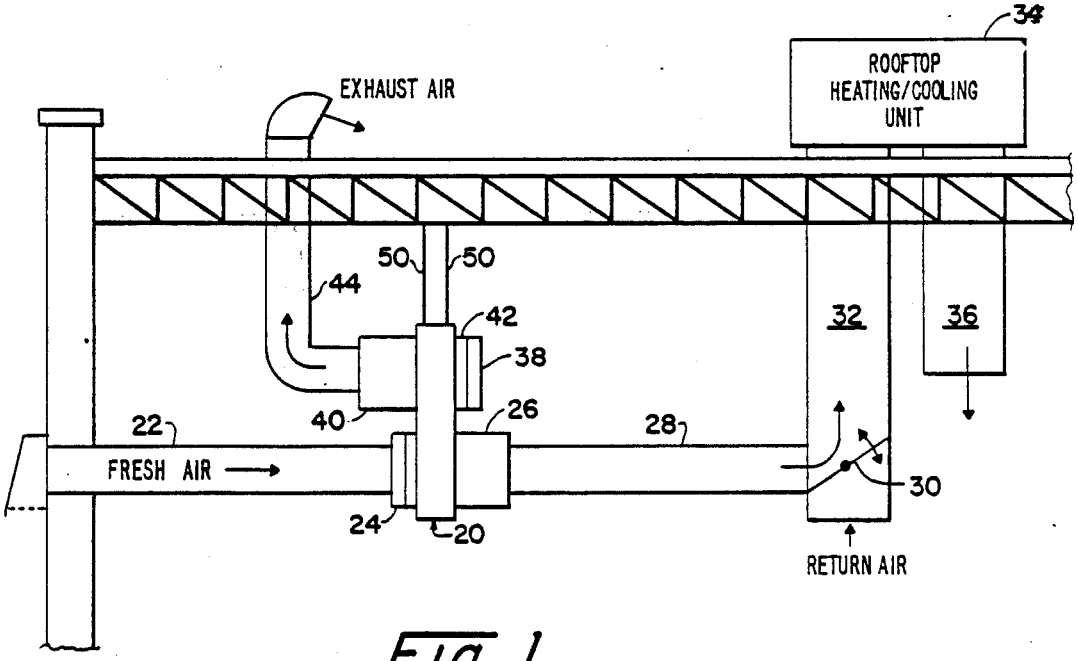
FIG. 1 is a schematic view of a building utilizing a HVAC system incorporating the rotary regenerative heat exchange assembly of the present invention.
Figure 2:
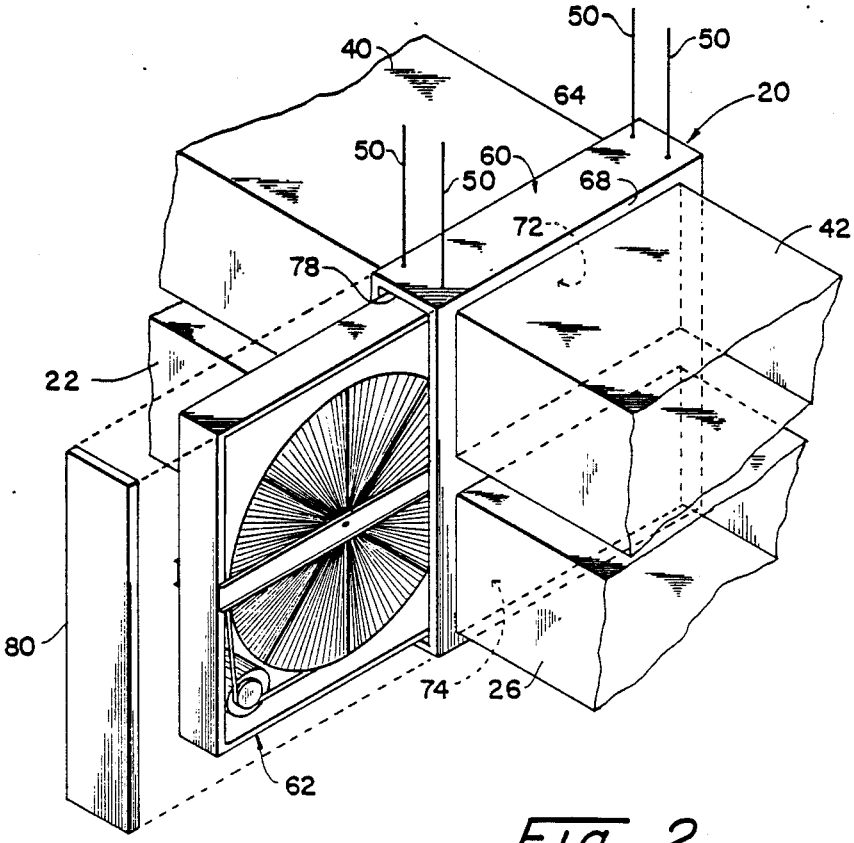
FIG. 2 is a perspective view of the rotary regenerative heat exchange assembly connected in the ductwork of the system shown in FIG. 1, with the cover removed and the "cassette" portion of the assembly partially removed from its operating position.

In FIG. 1, a typical HVAC system is modified to include the rotary regenerative heat exchange wheel assembly 20 in accordance with the principles of the present invention. More specifically, fresh air is drawn by the indoor blower 26 from the outside into the intake duct, indicated at 22, through air filter 24 and thence through the air intake side of the heat exchange wheel assembly 20. The fresh air is drawn through the heat exchange wheel, described in greater detail hereinafter, through the blower 26 into the transfer duct 28. In the system shown, duct 28 is connected to the air intake duct 32 for the rooftop heating/cooling unit 34. A damper 30 is provided so that interior air can be mixed with the air provided from the duct 28 so that interior air can be recirculated through the unit 34 in a manner well known in the art. Air is treated by the unit 34 (heated during cold weather and cooled during warm weather) and passed back into the interior of the building through the duct 36. Exhaust air is drawn by exhaust blower 40 through the filter 38 into a duct 42, through the air output side of the heat exchange wheel assembly 20, through the blower 40 into the exhaust duct 44 so that the exhaust air is vented to the outside.

The assembly 20, described in greater detail in FIGS. 2-9, is preferably suitably supported, such as by suspending the assembly from the ceiling with the suspension cables 50, so as to place a minimum load on the duct work. The assembly 20 includes a cabinet 60 and a heat exchange wheel means in the form of "cassette" 62 mounted to slide into and out of the cabinet.

Figure 3:
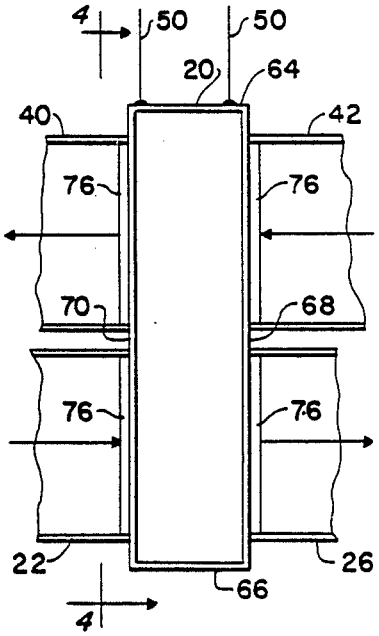
FIG. 3 is a side view, taken in cross section through the ductwork on opposite sides of the heat exchange assembly, showing the heat exchange assembly positioned in the ductwork.
Figure 4:
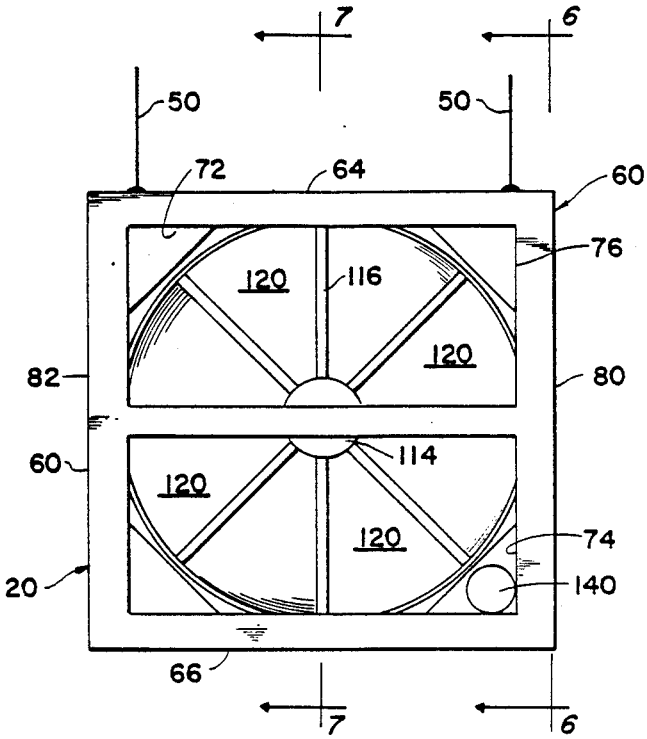
FIG. 4 is a cross sectional view taken along line 4—4 of FIG. 3.
Figure 5:
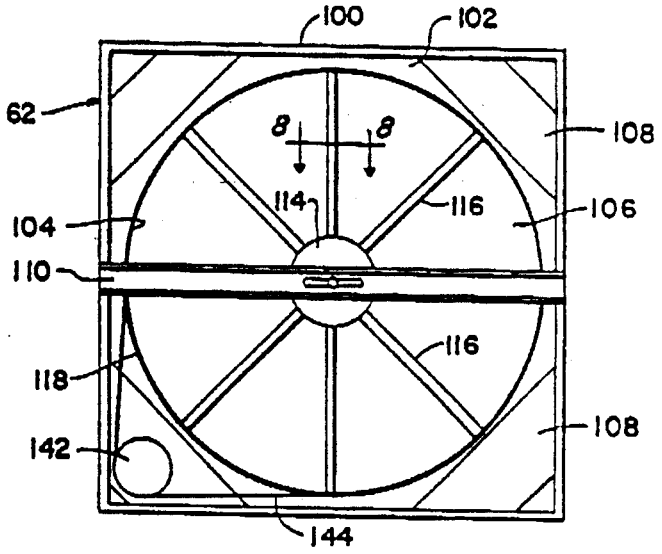
FIG. 5 is a front view of the cassette portion of the assembly removed from the cabinet portion of the assembly.

More specifically, as best seen in FIGS. 3 and 4 cabinet 60 includes a top plate 64 suitably attached to the cables 50. A bottom plate 66 is provided opposite the top plate 64. The cabinet also includes identical indoor and outdoor side plates 68 and 70 (see FIG. 3), disposed opposite one another with each being provided with top and bottom openings 72 and 74, respectively for connecting the duct 22 and blower 40 to the outdoor side plate 70 and the blower 26 and duct 42 to the indoor side plate 68. Duct flanges 76 are provided around the perimeter of each opening 72 and 74 so that the ducts and blowers can be attached in an air tight manner. The cabinet 60 also includes a open side 78 (see FIG. 2) so that the cassette 62 can be moved between the indoor and outdoor sides, in a direction parallel to the indoor and outdoor sides into and out of the cabinet. A cover plate 80 is provided to cover the open side 78 when the cassette is moved into its operating position. A side plate 82 (shown in FIG. 4) is provided opposite the open side 78.

Figure 6:
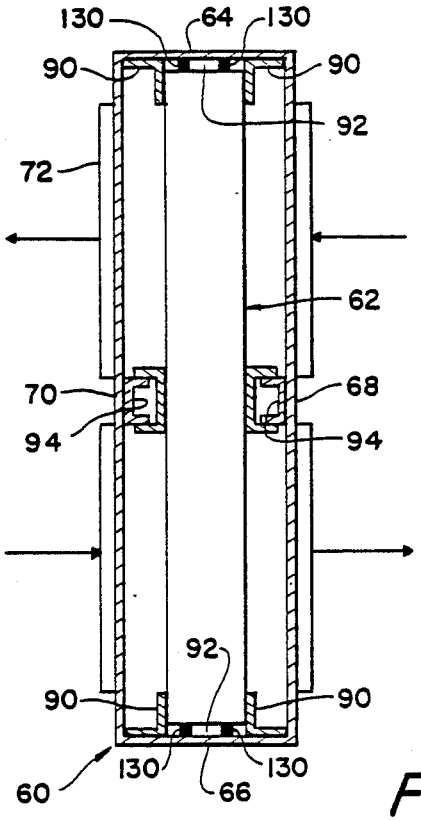
FIG. 6 is a cross-sectional view of the assembly taken along line 6—6 in FIG. 4.
Figure 7:
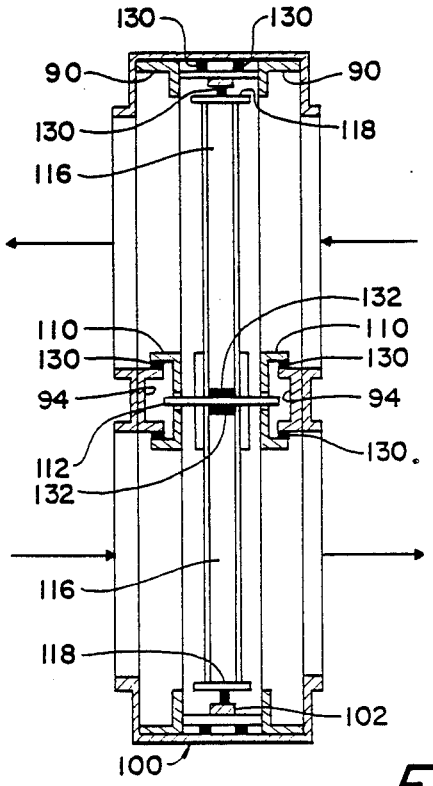
FIG. 7 is a cross-sectional view of the assembly taken along line 7—7 in FIG. 4.

As shown in greater detail in FIGS. 6 and 7 the cabinet includes means for supporting the cassette so that the latter is movable in the direction described. Preferably, the means for supporting the cassette includes a pair of L-brackets 90 connected to the inside surface of each of the top and bottom plates 64 and 66 so as to form a top and bottom channel 92 through which the cassette 62 can slide in a direction generally parallel to the indoor and outdoor side plates 68 and 70 into and out of the open side 78. The L-shaped brackets 90 also act to support the cassette and to provide a sliding surface to facilitate insertion and removal of the cassette when the latter is mounted in a horizontal position. In addition, a C-shaped channel 94 is secured to the inside of each of the indoor and outdoor side plates 68 and 70, between the openings 72 and 74 parallel to the channels 92 so as to form a track and therefore define the direction of movement of the cassette 62 as it is moved relative to cabinet 60.

Cassette 62, shown in detail in FIGS. 5-10, includes a frame 100 enclosing a center plate 102, which in turn includes a center opening 104 for receiving the rotary heat exchange wheel 106. Angle brackets 108 preferably reinforce the frame 100. A C-shaped channel 110 is secured to each face of the cassette to opposite sides of the frame 100 in a parallel relationship so that each slides on a corresponding channel 94 positioned in the cabinet 60 as the cassette 62 moves.

The wheel 106 is rotatably supported in the opening 104 on the rotatation shaft 112. The is suitably supported in journals provided in C-shaped channels 110 provided on opposite sides of the cassette. The wheel includes a hub 114 supported by the shaft 112, a plurality of spokes 116 and an outer band 118, which together form wedge shaped openings for supporting the wedge shaped elements 120 made of suitable heat exchange and dessicant materials. Such materials can be the type described in co-pending application, U.S. Ser. No. 790,198 filed Oct. 22, 1985 in the names of Donald F. Steele, Lawrence C. Hoagland, Christopher Kyricos and Peter Tolan and assigned to the present assignee, although other materials may be used.

Figure 10:
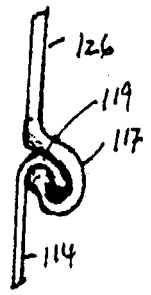
FIG. 10 is a cross-sectional view, partially cut away, taken along line 10—10 of FIG. 9.
Figure 8:
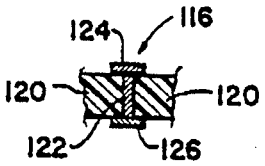
FIG. 8 is a partial cross-sectional view taken along line 8—8 in FIG. 5.
Figure 9:
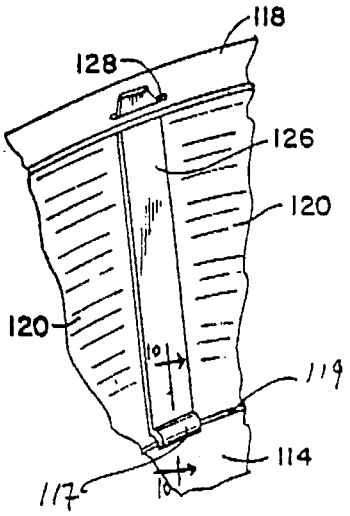
FIG. 9 is a perspective view of a portion of the wheel showing the removable strip for removing one or more of the wedges of heat exchange material.

As shown in FIGS. 8-10, each spoke 116 includes a center bar 122, extending between each wedge shaped element 120, and a strip 124 attached to an edge of each bar 122 so as to form a T-shaped cross section from the hub to the outer band 118 so that the radial directed edge of each wedge shaped element is disposed between bars 122 and held in place, against axial movement in one axial direction by the strip 124. Second strips 126 are adapted to be secured on the side of the wheel opposite the first strips, with one strip 126 being provided for each of the bars 122. Each strip 126 is positioned over the edge of the bar 122 and the adjoining edges of the adjacent wedge shaped elements so as to hold the wedge shaped elements from moving axially in the opposite direction. The strips 126 are adapted to be easily removed from the wheel so that one or more of the wedge-shaped elements can be removed from the wheel. As shown, for example, a slot 128 can be provided on the band 118 for receiving one end of a flexible strip 126, while the other end of the strip can be formed to cooperate with the hub 114, e.g., the other end of the strip can be formed as a hook 117 for hooking onto a pre-formed ridge 119 of the hub 114 as shown in FIG. 9. In addition, each wedge shaped element 120 is snuggly disposed against the hub 114, e.g., hooking onto a preformed flexible ridge 119 of the hub 115 as shown in FIGS. 9 and 10 and the band 118. Strip 126 can be made of any flexible material such as spring steel or the like.

In order to insure air passes through the wedge-shaped elements, a suitable air sealing material, such as pile seals and/or pads can be provided on the inside of the cabinet 60, along the channels 92 (see FIG. 6 at 130) and on the inside surfaces of the side plate 80 of the cabinet and on the inside surface of the cover 82 so that all of the outer edges of the frame 100 of the cassette are air tight when the cassette is mounted in the cabinet. Pile seals (see 130 in FIG. 7) are also provided between each C-shaped channel 94 and C-channel 110 so as to seal the air path through the wheel as defined by the openings 74 and the air path through the wheel as defined by the openings 76 so that the cool air passing through the wheel is sealed from the warm air passing through the wheel. Similarly, pads (indicated at 132) are provided between each wedge shaped element and the hub and pile seals are provided between the band 118 and the plate 102 in the opening 104 so that air will only pass through the wedge-shaped elements.

Finally, a motor 140 is secured to the plate 104 of the cassette, preferably through one of the brackets 108. The motor 140 drives a pulley 142 (see FIG. 2) which in turn drives the belt 144. Belt is suitably coupled to the wheel 106 so that the latter turns with shaft 112 in the jounals as the motor runs.

In operation the cabinet 60 can be suitably supported and secured to the ductwork of a ventilation system of a building. The motor 140 can be connected to a suitable power source so that the wheel 106 rotates at a constant speed, e.g., 25 rpm. In its operating location, the wheel is positioned within the cabinet 60 so that a portion of the wheel intercepts the cool air flowing in one direction, and a different portion of the wheel intercepts the warm air flowing in the opposition direction. As is well known rotating the wheel results in the portion of the wheel disposed in the warm air absorbing heat (and moisture where the wheel includes a dessicant material) as it moves through the warm air, and the cool air absorbing heat from that portion of the wheel as the latter moves through the cool air. In order to maintain and repair the heat exchange wheel 106, the cover 80 of the cabinet 60 is removed. The cassette 62 can then be pulled out through the open side 78. In this regard suitable stops can be provided to prevent the cassette from accidentally being pulled completely from the cabinet. The stops can be spring stops which can then be manipulated to allow the cassette to be completely removed if desired. The wheel can then be repaired and maintained. For example, the cassette can be cleaned. If desired, one or more wedge-shaped elements 120 can be removed by first removing the appropriate strips 126. The wedge-shaped elements 120 can then be removed by moving them axially through the space provided by the removal of the strips 126. The elements 120 can then be cleaned or replaced by sliding new elements into place and reinserting the strips 126.

It should be appreciated that the assembly 20 can be used with any ventilation system where there is a flow of relatively cool air and a flow of relatively warm air, and the wheel can be used to transfer heat and/or moisture from the warm air to the cool air.

The foregoing assembly provides substantial savings of capital equipment cost per 1,000 CFM of ventilation. For example, when outdoor air is 99° F. DB and 78° F. WB, and indoor air is 75° F. DB at 50% RH the ventilated air can be conditioned using the present invention to enter the building at an estimated 79° F. DB and 48% RH. The example illustrates the reduced load on an air conditioning system at summer temperature extremes and thus, the basis for downsizing of cooling equipment. A summer design condition commonly used throughout the United States is 95° F. DB and 75° F. WB. For this design condition, it is believed that cooling equipment capacity can be reduced by as much as 3.1 tons per 1,000 CFM at the time of design or when replacing existing equipment.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. A rotary regenerative heat exchange assembly comprising:

a heat exchange wheel assembly including a mounting frame, a heat exchange wheel having a rotation axis, a wheel frame including an inner hub and an outer band and radially-extending bars extending between said hub and outer band, a plate secured to said frame and having an opening; means for mounting said heat exchange wheel and wheel frame in said mounting frame for rotation within said opening of said plate about said rotation axis, motor means, secured to said mounting frame, for rotating said wheel about said axis, first seal means disposed between said wheel and said plate within said opening for preventing air from passing between said wheel and said plate and second seal means, fixed relative to said mounting frame on each side of said wheel, so as to divide said wheel into two air-flow sections, said heat exchange wheel including a plurality of wedge-shaped elements made of heat exchange material and means for securing said wedge-shaped elements in said wheel, said means for securing including a plurality of flexible strips a plurality of flexible strips releasably secured to said hub and outer band and cooperative with said radially-extending bars so that select ones of said wedges can easily be removed and inserted by removing select ones of said strips by flexing said strips so as to release and secure said strips from and to said hub and outer band; and cabinet means comprising a first opening for receiving said heat exchange wheel assembly in an operative position, means for supporting said heat exchange wheel assembly so that said wheel assembly can be slid from said first opening to said operative position and slid back out said opening in order to maintain said wheel assembly, and air flow openings for securing said heat exchange assembly to a source of relatively cool air and to a source of relatively warm air so that when said heat exchange wheel assembly is properly located in said operative position in said cabinet means one of said air flow sections of said heat exchange wheel intercepts the flow of said relatively cool air and the other of said air flow sections of said wheel intercepts the flow of said relatively warm air and said second seal means prevents the cross leakage of relatively cool air through said other section of said wheel and of relatively warm air through said one section of said wheel.

2. An assembly according to claim 1, wherein said cabinet means includes a removable cover for covering said first opening.

3. An assembly according to claim 1, wherein said means for supporting said heat exchange wheel assembly includes means for defining a track within said cabinet means, and wherein said heat exchange wheel assembly further includes means for cooperating with said track so as to limit the direction of movement of said heat exchange wheel assembly to the direction of said track.

4. An assembly according to claim 3, wherein said track includes a pair of channel members secured within the interior of said cabinet means in a direction parallel to the direction of sliding movement of said heat exchange wheel assembly, and said heat exchange wheel assembly includes means, cooperative with said channel members so as to limit the sliding movement of said heat exchange wheel assembly to said direction of sliding movement.

5. A rotary regenerative heat exchange wheel assembly comprising a mounting frame, a heat exchange wheel having a rotation axis, a wheel frame including an inner hub and an outer band and radially-extending bars extending between said hub and outer band, a plate secured to said frame and having an opening; means for mounting said heat exchange wheel and wheel frame in said mounting frame for rotation within said opening of said plate about said rotation axis and motor means, secured to siad mounting frame, for rotating said wheel about said axis, seal means disposed between said wheel and said plate within said opening for preventing air from passing between said wheel and said plate, said heat exchange wheel including a plurality of wedge-shaped elements made of heat exchange material and means for securing said wedge-shaped elements in said wheel, said means for securing including a plurality of flexible strips releasably secured to said hub and outer band and cooperative with said radially-extending bars so that select ones of said wedges can easily be removed and inserted by removing select ones of said strips by flexing said strips so as to release and secure said strips from and to said hub and outer band.

* * * * *

UNITED STATES PATENT AND TRADEMARK OFFICE

CERTIFICATE OF CORRECTION

PATENT NO. : 4,924,934

DATED : May 15, 1990

INVENTOR(S) : Donald F. Steele

It is certified that error appears in the above-identified patent and that said Letters Patent is hereby corrected as shown below:

Claim 5, column 6, line 54, delete "siad" and substitute therefor -- said --.

Signed and Sealed this

Twentieth Day of August, 1991

*Attest:*

HARRY F. MANBECK, JR.

*Attesting Officer*

*Commissioner of Patents and Trademarks*